United States Patent [19]

Campbell et al.

[11] Patent Number: 5,073,162

[45] Date of Patent: Dec. 17, 1991

[54] APPARATUS FOR FORMING CONTAINERS WITH ROUNDED EDGES

[75] Inventors: Christopher J. Campbell, Midlothian; Linda S. Latif, Richmond, both of Va.; Herman Graboyes, Norristown, Pa.

[73] Assignee: Philip Morris Incorporated, New York, N.Y.

[21] Appl. No.: 573,991

[22] Filed: Aug. 28, 1990

Related U.S. Application Data

[62] Division of Ser. No. 547,562, Jul. 2, 1990, which is a division of Ser. No. 312,860, Feb. 21, 1989, Pat. No. 4,955,531.

[51] Int. Cl.[5] ..... B31B 1/25

[52] U.S. Cl. ..... 493/396; 493/354

[58] Field of Search ..... 493/354, 355, 396, 397, 493/400

[56] References Cited

U.S. PATENT DOCUMENTS

| | | | |
|---|---|---|---|
| 416,115 | 11/1889 | Mayall | 229/DIG. 4 |
| 758,672 | 5/1904 | Mayall | 229/DIG. 4 |
| 1,102,877 | 7/1914 | Clark | 229/DIG. 4 |
| 1,482,569 | 2/1924 | Lange | 229/DIG. 4 |
| 1,565,765 | 12/1925 | Walter | 229/DIG. 4 |
| 1,821,668 | 9/1931 | Ross | 229/DIG. 4 |
| 2,043,419 | 6/1936 | Robinson | 229/DIG. 4 |
| 2,371,317 | 3/1945 | Ringler | 229/182.1 |
| 2,586,301 | 2/1952 | Castle | 229/182.1 |
| 2,634,563 | 4/1953 | Magill et al. | 229/4.5 |
| 2,765,716 | 10/1956 | Andersson | 493/396 |
| 3,526,566 | 9/1970 | McIlvain, Jr. et al. | 229/DIG. 4 |
| 4,020,988 | 5/1977 | Kipp | 229/16 A |
| 4,129,065 | 12/1978 | Corse | 493/396 |
| 4,373,929 | 2/1983 | Smith | 493/61 |
| 4,559,259 | 12/1985 | Cetrelli | 493/60 |
| 4,708,704 | 11/1987 | Focke et al. | 493/151 |

FOREIGN PATENT DOCUMENTS

| | | | |
|---|---|---|---|
| 132413 | 5/1949 | Australia | 229/4.5 |
| 205766 | 12/1986 | European Pat. Off. . | |
| 2149850 | 6/1972 | Fed. Rep. of Germany | 229/DIG. 4 |
| 3615828 | 11/1987 | Fed. Rep. of Germany . | |
| 3615827 | 12/1987 | Fed. Rep. of Germany . | |
| 444725 | 3/1936 | United Kingdom | 229/4.5 |

*Primary Examiner*—William E. Terrell

*Attorney, Agent, or Firm*—Robert R. Jackson

[57] ABSTRACT

To produce a container with a rounded edge, the container blank is scored with several substantially parallel, laterally spaced score lines adjacent the intended location of the rounded edge. When the blank is bent, a portion of the total deflection is absorbed by each score line so that the resulting container edge is a gradual curve rather than a single sharp crease. The ends of each scored region may be left unscored to further smooth the ends of the rounded container edge. Methods and apparatus for forming the above-described blank are disclosed.

12 Claims, 4 Drawing Sheets

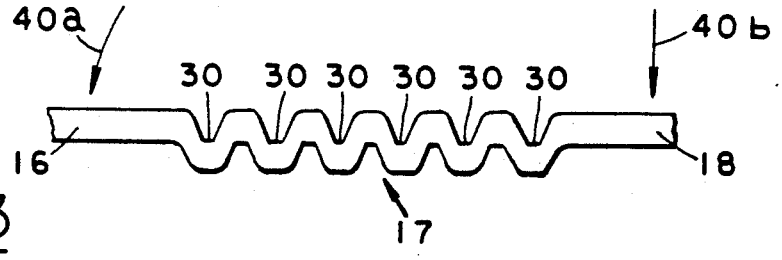
FIG. 3
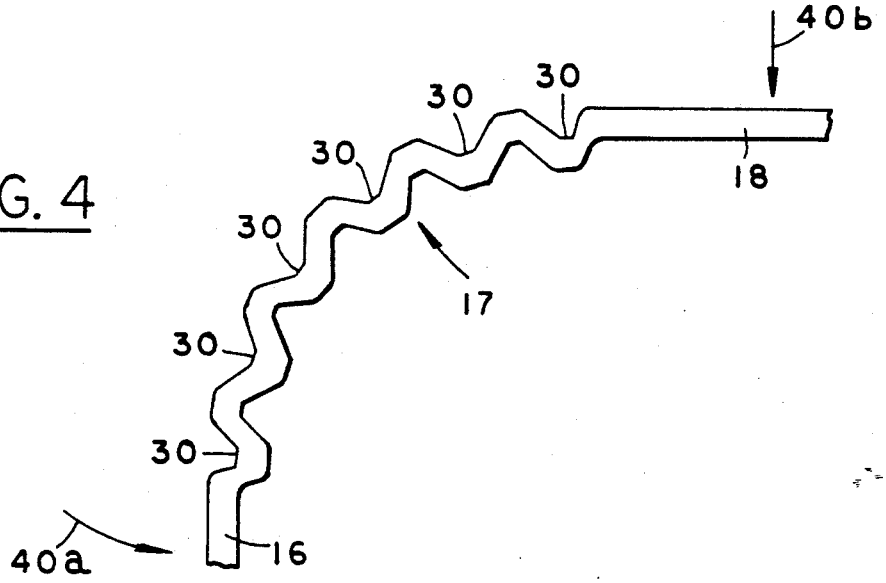
FIG. 4
FIG. 5
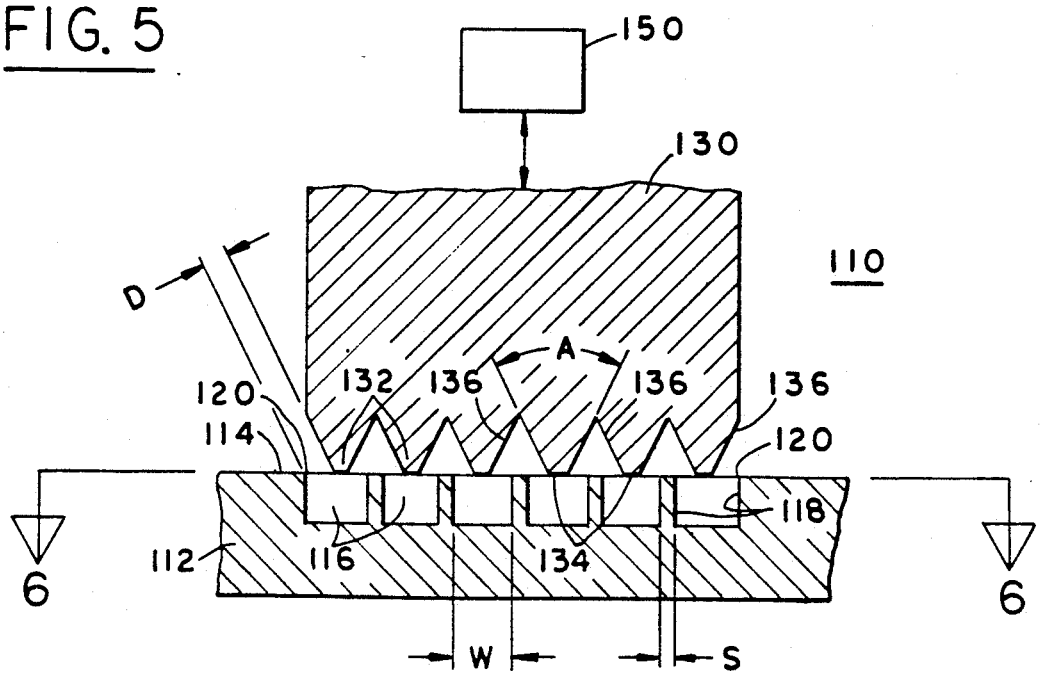

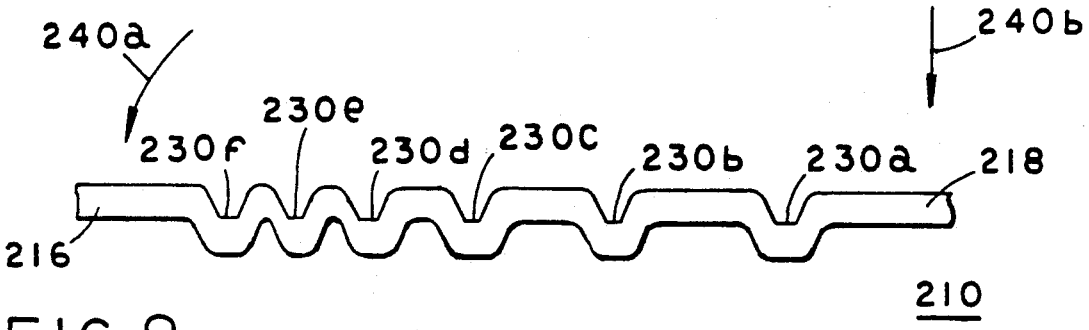
FIG. 8
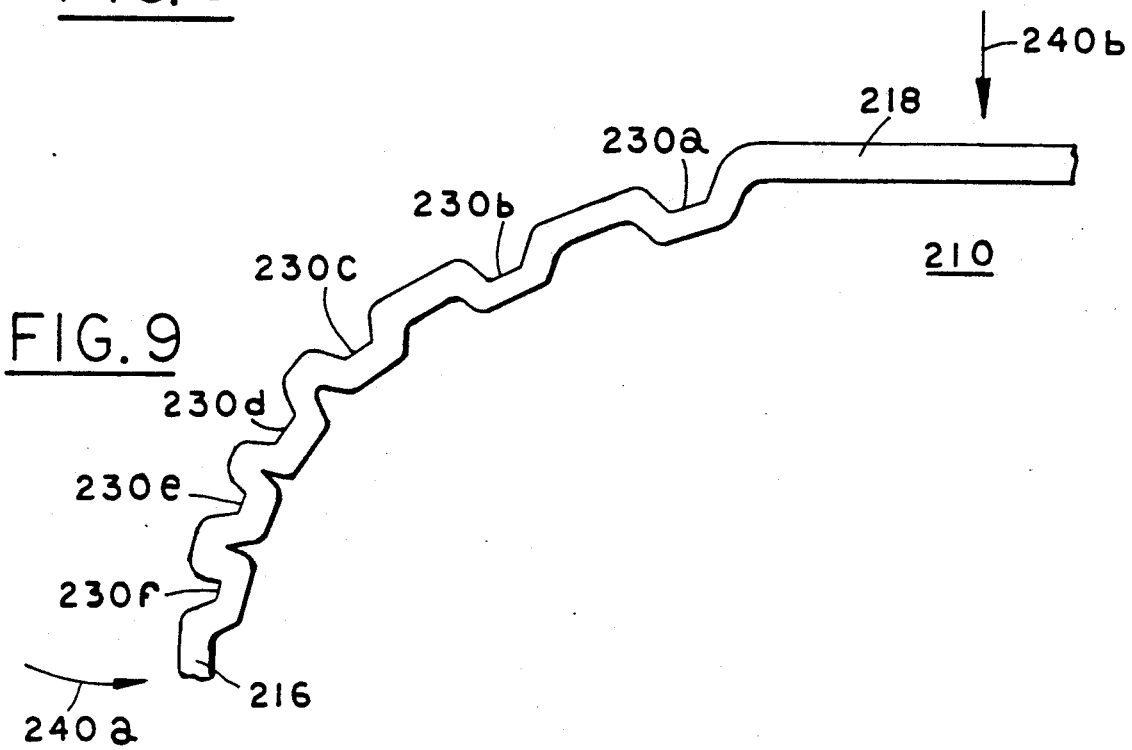
FIG. 9
FIG. 10
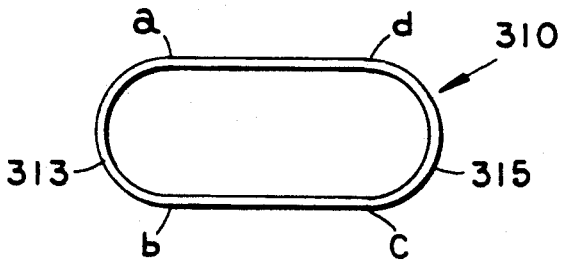
FIG. 11
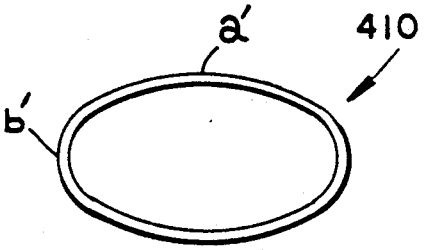

APPARATUS FOR FORMING CONTAINERS WITH ROUNDED EDGES

This is a division of application Ser. No. 07/547,562, filed July 2, 1990, and application Ser. No. 07/312,860 filed Feb. 21, 1989 (U.S. Pat. No. 4,955,531).

BACKGROUND OF THE INVENTION

This invention relates to methods and apparatus for forming containers (e.g., cigarette boxes) with curved or rounded edges, and also to blanks for making such containers.

Many consumers prefer to purchase cigarettes in boxes rather than soft packages. Among the reasons for this preference is the fact that a box tends to protect its contents somewhat better than a soft package. One disadvantage of boxes, however, is that they may have sharper and stiffer edges than a soft package. This may increase the wear on accessories (e.g., handbags) or articles of clothing (e.g., shirt pockets) in which the box is carried. Many consumers have also been found to prefer the "softer" feel of containers with curved or rounded edges.

In view of the foregoing, it is an object of this invention to provide methods and apparatus for making containers such as cigarette boxes with curved or rounded edges.

It is another object of this invention to provide container blanks which, when formed into containers, automatically tend to have curved or rounded edges.

SUMMARY OF THE INVENTION

These and other objects of the invention are accomplished in accordance with the principles of the invention by providing many parallel, closely spaced score lines in a container blank at the intended location of each curved or rounded edge. When the blank is subsequently bent, some of the bending deflection occurs at each score line. Accordingly, the overall bending deflection is distributed over the several score lines, with the result that the edge is gradual or rounded as desired. Preferred apparatus for producing the above-described score lines includes a counter plate having a plurality of parallel, laterally spaced grooves, and a punch having a plurality of parallel, laterally spaced ridges. The container blank is placed between the counter plate and the punch, and the punch is moved toward the counter plate so that the ridges deform the blank into the grooves, thereby producing the desired plurality of closely spaced score lines. If desired, a small portion of the blank adjacent the ends of the score lines may be left unscored. This advantageously smoothes the end of the edge by masking the undulations associated with the score lines.

Further features of the invention, its nature and various advantages will be more apparent from the accompanying drawings and the following detailed description of the invention.

BRIEF DESCRIPTION OF THE DRAWINGS

FIG. 1 shows the surface of the blank that will be, for the most part, on the outside of the finished container.

FIG. 3 is an enlarged sectional view taken along the line 3—3 in FIG. 1.

FIG. 4 shows the structure of FIG. 3 after bending through an angle of 90°.

FIG. 5 is a partial sectional view of apparatus constructed in accordance with the principles of this invention which can be used to form a blank of the type shown in FIG. 1. FIG. 5 is taken along the line 5—5 in FIG. 7.

FIGS. 8 and 9 are views respectively similar to FIGS. 3 and 4 showing an alternative embodiment of the invention.

FIG. 10 is a view generally similar to FIG. 2 showing yet another alternative embodiment of the invention.

FIG. 11 is a view generally similar to FIG. 2 showing still another alternative embodiment of the invention.

DETAILED DESCRIPTION OF THE INVENTION

Figure 1:
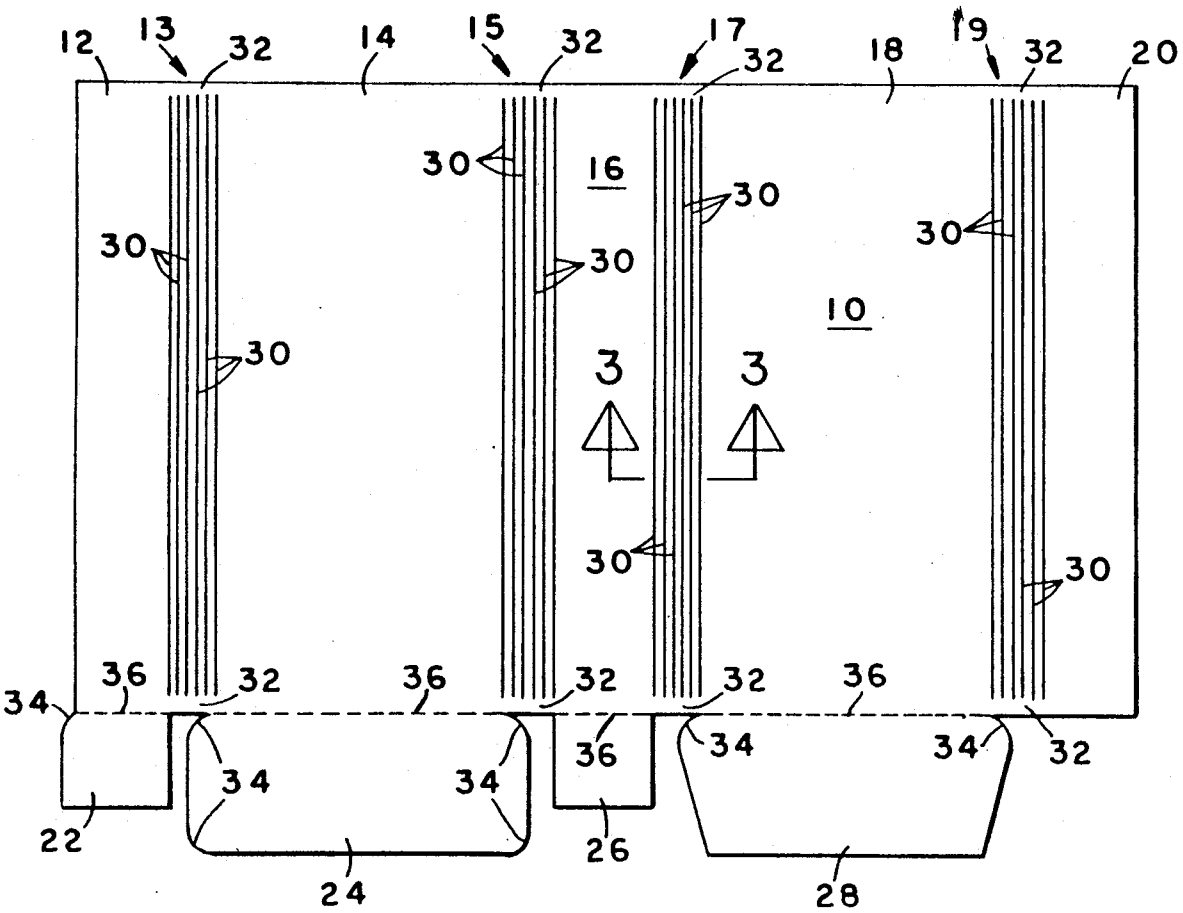
FIG. 1 is a view of a container blank embodying the present invention.

FIG. 1 shows a typical cigarette box blank 10 embodying the present invention. For simplicity, blank 10 is shown without the components required to form a top, but such components are well known and could be either integral with or separate from blank 10 (e.g., a top could be formed separately and then glued onto the remainder of the box). Blank 10 includes front panel 14 and rear panel 18 which are integrally connected by right side panel 16. Left side panel 12 extends to the left from front panel 14, and side tab panel 20 extends to the right from rear panel 18. Bottom panel 24 extends down from front panel 14, and bottom tab panels 22, 26, and 28 extend down from panels 12, 16, and 18, respectively. A typical material for blank 10 is 0.012 inch thick cardboard.

Figure 2:
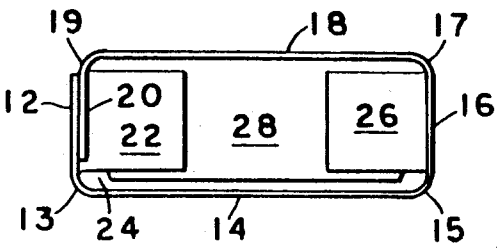
FIG. 2 is a view looking down into the interior of a container made from the blank of FIG. 1.

In the finished box made from blank 10 (see FIG. 2), left side panel 12 is glued over side tab panel 20, and bottom tab panel 28 is glued over bottom tab panels 22 and 26, with bottom panel 24 glued over bottom tab panel 28.

At the intended locations of each of the four vertical edges 13, 15, 17, and 19 of the box, blank 10 has a plurality of score lines 30 extending along most (but preferably not quite all) of the height of the blank parallel to the longitudinal axis of the associated intended edge. In the particular embodiment shown in FIGS. 1-4, six parallel, laterally spaced score lines 30 are provided at the location of each intended vertical edge. In this embodiment, all of score lines 30 are preferably identical to one another, and within each group the score lines are preferably evenly spaced from one another. A greatly enlarged cross section of blank 10 at the location of one typical group of score lines 30 is shown in FIG. 3.

As a result of the presence of score lines 30, when blank 10 is bent about the longitudinal axis of any of the intended vertical edges of the box (see, for example, FIGS. 3 and 4 in which bending forces are represented by arrows 40*a* and 40*b*, and in which FIG. 4 shows the structure of FIG. 3 after bending), a gradual or rounded edge automatically results. This is because each of score lines 30 absorbs a portion of the total bending deflection so that the total deflection is distributed substantially uniformly among the score lines. Accordingly, the resulting edge curvature is spread out along the width of the scored region, which becomes a gradual arc rather than a sharp crease or fold as in prior art boxes. A typical radius of curvature in accordance with the present invention is approximately 0.125 inch (one-eighth of an inch). Note that the curved edge forms naturally without the need for a special forming tool or support in contact with the edge to give the desired shape.

As mentioned above, the extreme upper and lower ends 32 of each region of score lines 30 are unscored for a short distance (e.g., a distance approximately equal to the thickness of the blank, which is approximately 0.012 inch in the depicted embodiment). These short unscored end regions 32 do not in any way interfere with the formation of rounded edges as described above. The advantage of unscored end regions 32 is that they tend to smooth out the extreme ends of each rounded edge by, in effect, masking and/or cushioning any possibly sharp edges or corners associated with score lines 30. Accordingly, unscored end regions 32 even further reduce the tendency of the finished box to cause wear of the accessory or article of clothing in which the box is carried.

Note in FIG. 1 that the edges of tabs and panels 22, 24, and 28 that will be adjacent to vertical edges 13, 15, 17, and 19 in the finished box are rounded (as at 34) to match the rounded edges that result from the score line structure described above. Conventional single score lines 36 are employed between elements 12 and 22, elements 14 and 24, elements 16 and 26, and elements 18 and 28 to facilitate folding of the bottom components relative to the side components.

Figure 6:
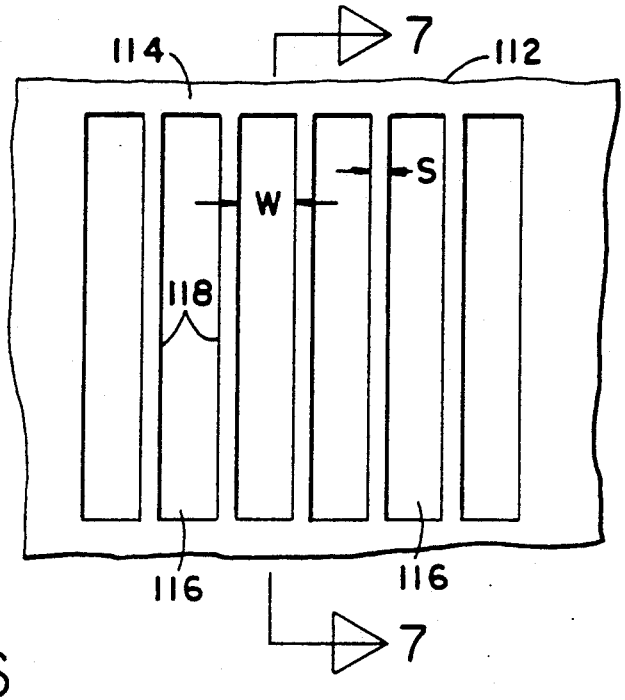
FIG. 6 is a plan view of a portion of the apparatus of FIG. 5, taken along the line 6—6 in FIG. 5.
Figure 7:
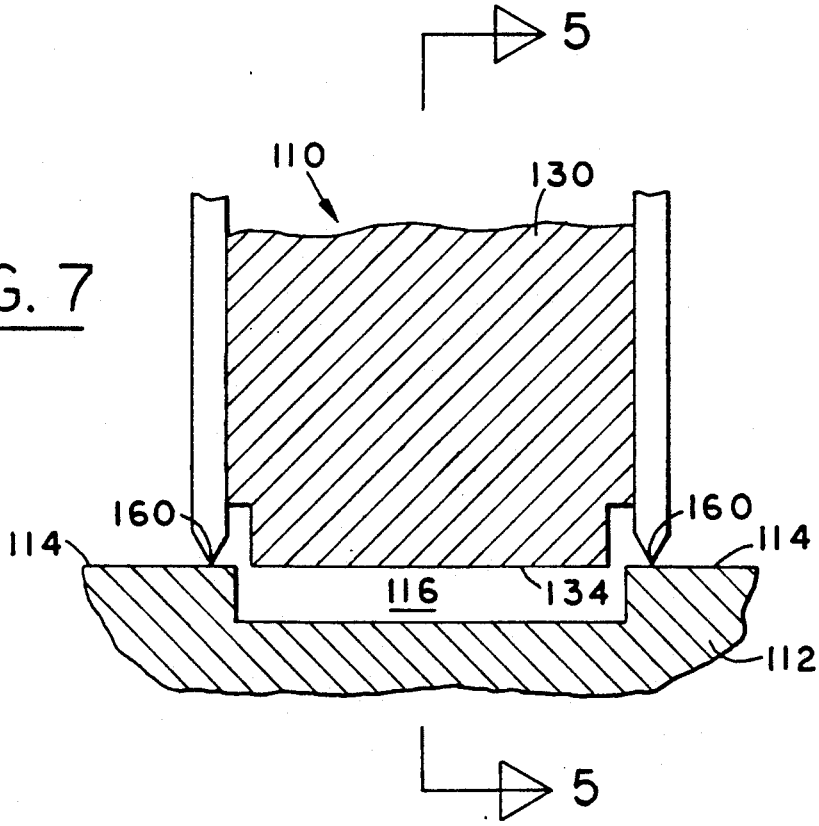
FIG. 7 is a partial sectional view of the apparatus of FIGS. 5 and 6 taken along the line 7—7 in FIG. 6.

Preferred apparatus 110 for forming score lines 30 and associated elements is illustrated by FIGS. 5-7. Prior to scoring, blank 10 (or the stock from which blank 10 will be cut) is laid out on the substantially flat upper surface 114 of counter plate 112. Below the intended location of each score line 30, counter plate 112 has a groove 116. In the depicted preferred embodiment, each groove is deeper than the thickness of blank 10 (e.g., 0.014 inch deep when blank 10 is 0.012 inch thick) and more than twice as wide as the thickness of the blank (e.g., 0.031 inch wide when the blank is 0.012 inch thick). Also in the depicted preferred embodiment, the spacing S between adjacent grooves is preferably less than the thickness of the blank (e.g., 0.008 inch when blank 10 is 0.012 inch thick). The side surfaces 118 of each groove 116 are preferably planar and perpendicular to surface 114. In addition, surfaces 118 meet surface 114 at right angled corners 120.

A punch 130 is located above counter plate 112 for cooperation therewith. Punch 130 has a downwardly extending ridge 132 centrally aligned with each groove 116. The apex surface 134 of each ridge 132 is preferably substantially flat and parallel to surface 114. In addition, in this embodiment, all of apex surfaces 134 are co-planar. The side surfaces 136 of each ridge 132 are preferably substantially planar and anticlinal in the direction away from the associated apex. In particular, the included angle A between each pair of side surfaces 136 is preferably in the range from about 0° to about 45°. Most preferably, angle A is about 45°. The width of each apex surface 134 is preferably less than the thickness of blank 10 (e.g., 0.005 inch when blank 10 is 0.012 inch thick).

Means 150 (e.g., a conventional double-acting hydraulic or pneumatic ram) are provided for vertically reciprocating punch 130. On the downward stroke, punch 130 preferably moves down until apex surfaces 134 are approximately co-planar with surface 114. (Note that with the dimensions given above, when punch 130 is in this position, the smallest dimension D between each surface 136 and the closest corner 120 is preferably approximately equal to the thickness of blank 10 (i.e., 0.012 inch).) Accordingly, when a blank 10 is in place on surface 114, the lowering of punch 130 causes each ridge 132 to deform the adjacent portion of the blank down into the associated channel 116, thereby forming a score line 30 in the blank at the location of each ridge 132. When punch 130 is subsequently raised by element 150, these score lines 30 remain in the blank. Note that score lines 30 are preferably on the convex outward side when the blank is subsequently bent (see FIG. 4).

To produce the unscored portions 32 at each end of the scored regions, ridges 132 are slightly shorter than grooves 116 (see FIG. 7). For example, each groove 116 may extend beyond each end of the associated ridge 132 by a distance approximately equal to the thickness of blank 10 (e.g., 0.012 inch). In addition, the knife edge 160 that cuts through the blank adjacent the ends of the scored regions may be spaced beyond the end of grooves 116 by a further distance approximately equal to the thickness of the blank (e.g., 0.012 inch). The combination of grooves 116 longer than ridges 132 and knife edge 160 beyond the end of grooves 116 ensures a small but well-defined unscored region 32 at each end of each scored region. This region 32 is preferably long enough parallel to the longitudinal axes of the adjacent score lines 30 to ensure that, when the blank is bent as illustrated, for example, by FIG. 4, the otherwise fluted end of the curved container edge will be substantially smoothed out. On the other hand, region 32 is preferably not so long that it interferes with the above-described functioning of the associated scored region to produce a rounded container edge when the blank is bent. In other words, when the blank is bent, unscored region 32 follows the overall curvature of the associated scored region, but does not follow all of the minute undulations of the scored region. Accordingly, unscored regions 32 advantageously smooth out each end of each scored region in the finished container.

The curvature of the container edges produced in accordance with this invention can be altered by changing various parameters of the scoring apparatus. For example, more gradual curves with a larger radius of curvature tend to result from such factors as (1) the use of shallower score lines, (2) the use of wider score lines (which can be produced, for example, by increasing the width W of grooves 116), (3) increasing the spacing between adjacent score lines, and/or (4) increasing the number of score lines. Sharper edges with a smaller radius of curvature tend to result from such factors as (1) the use of deeper score lines, (2) decreasing the spacing between adjacent score lines, and/or (3) reducing the included angle A of ridges 132.

These techniques for varying the radius of curvature can be employed to produce container edges having compound curvature (i.e., edges having one radius of curvature in one axial or arcuate region and a different radius of curvature in another axial or arcuate region). For example, edges which approximate arcs of ovals can be produced by having the score lines progress from fairly far apart to fairly close together as one proceeds from the portion of the oval arc having the larger radius of curvature to the portion of the arc having the smaller radius of curvature. This is illustrated by FIGS. 8 and 9 in which score lines 230*a* and 230*b* are relatively far apart, score lines 230*e* and 230*f* are relatively close together, and intermediate score line spacing is used for the score lines in between. As a consequence, when blank 210 is bent as shown in FIG. 9, the resulting rounded edge has a relatively large radius of curvature in the region of score lines 230*a* and 230*b*, and a smaller radius of curvature adjacent score lines 230*e* and 230*f*.

Although in the embodiments shown in FIGS. 1–4, 8, and 9, each rounded edge forms a 90 degree angle, this is not necessarily the case. For example, FIG. 10 shows a package 310 produced in accordance with this invention in which the scored regions extend from point a to point b and from point c to point d. Accordingly, package 310 has two rounded edges 313 and 315, each of which forms an angle of 180 degrees. In FIG. 11, the principle illustrated in FIG. 9 is extended to produce a package 410 which is substantially oval-shaped.

It will be understood that the foregoing is merely illustrative of the principles of the invention, and that various modifications can be made by those skilled in the art without departing from the scope of spirit of the invention. For example, the particular dimensions given above are merely illustrative of preferred embodiments. Other dimensions ca be employed if desired.

We claim:

1. Apparatus for working on an initially flat workpiece of predetermined thickness to cause the workpiece to have a rounded edge when bent about a longitudinal edge axis comprising:

a counter plate having a surface for receiving one flat surface of said workpiece, said counter plate surface being substantially flat except for a plurality of longitudinal, substantially parallel, laterally spaced grooves, each of said grooves being substantially parallel to said longitudinal edge axis and having lateral side surfaces which are substantially perpendicular to said counter plate surface;

a punch having a plurality of longitudinal, substantially parallel, laterally spaced ridges, the number and lateral spacing of said ridges being equal to the number and lateral spacing of said grooves, and each of said ridges being aligned with a respective one of said grooves and having a substantially flat apex and side surfaces which are synclinal toward said apex, the spacing between the side surfaces of each groove being slightly greater than a distance equal to twice said predetermined thickness plus the width of the apex of the associated ridge, the spacing between at least one groove and an adjacent groove being less than said distance; and means for moving said punch toward the counter plate surface so that the apex of each ridge contacts the other flat surface of said workpiece and forces the adjacent portion of the workpiece into the associated groove in order to produce one of a plurality of substantially parallel, laterally spaced score lines in said workpiece.

2. The apparatus defined in claim 1 wherein the apex of each ridge is substantially parallel to said counter plate surface.

3. The apparatus defined in claim 2 wherein the flat apex surfaces of all of said ridges are co-planar.

4. The apparatus defined in claim 3 wherein said means for moving said punch toward said counter plate surface includes means for stopping said movement when the flat apex surfaces of said ridges are co-planar with said counter plate surface.

5. The apparatus defined in claim 1 wherein each groove is deeper than said predetermined thickness and the spacing between said grooves is less than said predetermined thickness.

6. The apparatus defined in claim 5 wherein the lateral side surfaces of each groove are substantially planar.

7. The apparatus defined in claim 6 wherein each side surface of each groove meets said counter plate surface at a right angle.

8. The apparatus defined in claim 7 wherein the apex of each ridge is substantially parallel to said counter plate surface, the width of each flat apex surface being less than said predetermined thickness.

9. The apparatus defined in claim 8 wherein the included angle between the side surfaces of each ridge is in the range from more than 0° to about 45°.

10. The apparatus defined in claim 9 wherein the included angle between the anticlinal side surfaces of each ridge is approximately 45°.

11. The apparatus defined in claim 1 wherein a portion of said workpiece adjacent at least one end of said score lines is left unscored, said unscored portion being of sufficient length parallel to said score lines to substantially smooth the end of said edge when said workpiece is bent, but not so long as to interfere with the rounded formation of said edge or to fail to follow the overall curvature of said edge.

12. The apparatus defined in claim 11 wherein the length of said unscored portion parallel to said score lines is approximately equal to said predetermined thickness.

* * * * *